United States Patent [19]

Hakata

[11] 4,386,856

[45] Jun. 7, 1983

[54] MINIATURE ELECTRONIC DEVICE HAVING TIME INFORMING SOUND GENERATING FUNCTION

[75] Inventor: Masayuki Hakata, Ome, Japan

[73] Assignee: Casio Computer Co., Ltd., Tokyo, Japan

[21] Appl. No.: 212,497

[22] Filed: Dec. 3, 1980

[30] Foreign Application Priority Data

Dec. 17, 1979 [JP] Japan ..... 55-175217[U]

[51] Int. Cl.[3] ..... G04B 23/02; G04B 21/02

[52] U.S. Cl. ..... 368/72; 368/75; 368/245

[58] Field of Search ..... 368/72–75, 368/250, 251, 245, 261; 340/384 G

[56] References Cited

U.S. PATENT DOCUMENTS

| | | | |
|---|---|---|---|
| 4,203,278 | 3/1980 | Konzo et al. | 368/73 |
| 4,271,495 | 6/1981 | Scherzinger et al. | 368/75 |
| 4,280,209 | 7/1981 | Mooney | 368/71 |

*Primary Examiner*—Vit W. Miska

*Attorney, Agent, or Firm*—Frishauf, Holtz, Goodman & Woodward

[57] ABSTRACT

In a miniaturized electronic device having two time informing sound generating functions, namely time signaling and alarm sound generating functions, the volume of the sound produced is automatically controlled such that it is different at the time of the time signaling sound generation and at the time of the alarm sound generation.

5 Claims, 5 Drawing Figures

MINIATURE ELECTRONIC DEVICE HAVING TIME INFORMING SOUND GENERATING FUNCTION

BACKGROUND OF THE INVENTION

This invention relates to miniature electronic devices having two time informing sound generating functions, namely time signaling and alarm sound generating functions.

As miniature electronic devices such as miniature electronic calculators having a timepiece function that have been proposed in the past, there are those in which time signaling sound, for instance for every hour such as 0 o'clock, 1 o'clock and so forth, and also alarm sound for a given alarm time (specified by hour, minute and second data) are produced from a sound generator such as a piezoelectric buzzer.

In such a miniature electronic calculator or the like having both the time signaling and alarm sound generating functions, the sound generator such as a piezoelectric buzzer is driven from a single drive circuit at the time of producing the time signaling sound and also at the time of producing the alarm sound. In other words, the time signaling sound and alarm sound are produced with the same volume. Therefore, where the alarm time is set for awakening the user, it is likely that the user is awakened not by the alarm sound but by the time signaling sound. This is inconvenient for the user.

The invention is intended, in light of the above, to provide a miniature electronic device having a time informing sound generating function, in which the volume of the sound produced is controlled such that it is changed at the time of the time signaling sound generation and also at the time of the alarm sound generation.

SUMMARY OF THE INVENTION

To achieve this objective, the miniature electronic device having a time informing sound generating function according to the invention comprises a time counting means for counting a reference frequency signal to obtain present time information and a signaling time signal, a means for setting an alarm time, an alarm signal generating means at the time of the practical coincidence of the alarm time set in the alarm time setting means and the present time information provided by the time counting means, a sound generating means for informing the signaling time and alarm signal in response to the signaling time signal and to the alarm signal respectively, and sound volume control means coupled to the sound generating means for changing the volume of the sound produced from said sound generating means in accordance with the signaling time signal and alarm signal.

With the miniature electronic device having a time informing sound generating function according to the invention, the sound volume can be automatically controlled by the internal circuit such that it is different at the time of the alarm sound generation and at the time of the time signaling sound generation. Thus, by setting such that the sound volume is higher at the time of the alarm sound generation, for instance, the alarm sound and time signaling sound can be clearly distinguished from each other, so that the possibility of mistaking the alarm time for the signaling time or vice versa can be prevented. Also, it is possible to reliably prevent the user from being awakened by the time signaling sound.

This invention can be more fully understood from the following detailed description when taken in conjunction with the accompanying drawings:

DETAILED DESCRIPTION

Figure 1:
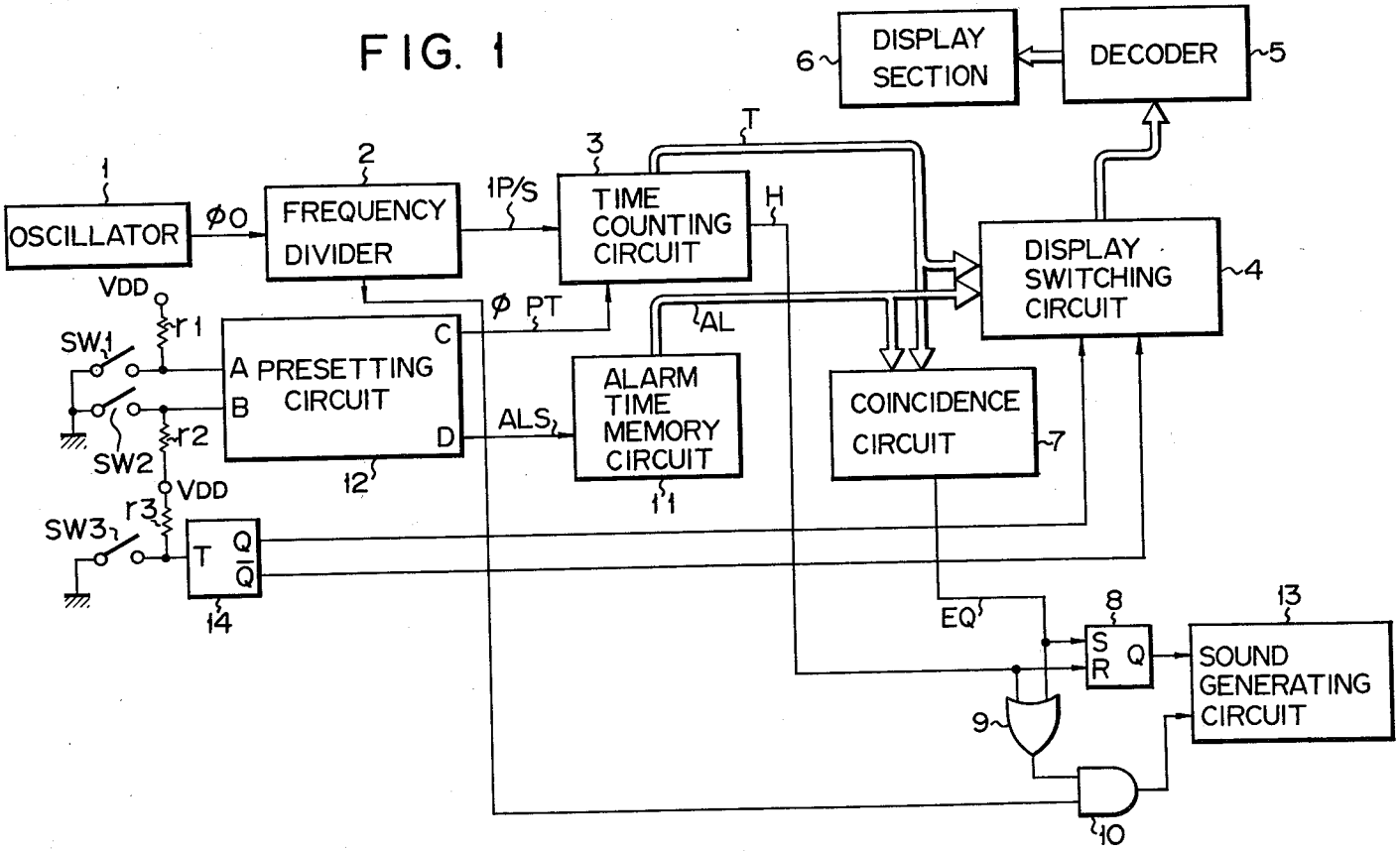
FIG. 1 is a block diagram, partly in circuit diagram, showing the circuit construction of an embodiment of the invention applied to an electronic wristwatch.

Now, an embodiment of the invention applied to an electronic wristwatch will be described with reference to the drawings. Referring now to FIG. 1, an oscillator (OSC) 1 supplies a reference frequency signal Φ0 at a frequency of 32.768 kHz to a frequency divider 2. The frequency divider 2 divides the reference frequency signal Φ0 to obtain a signal 1P/S, with a period of one second for instance, which is coupled to a time counting circuit 3 and counted therein. The time counting circuit 3 consists of a second counter, a minute counter and an hour counter, and it counts the signal 1P/S and produces present time information T and a signaling time signal H. The present time information T is transferred through a display switching circuit 4 and a decoder 5 to a display section 6 so that it is displayed therein. It is also transferred to a first input terminal A of a coincidence circuit 7. The time alarm signal, on the other hand, is coupled to a reset input terminal R of an S-R flip-flop 8 for resetting this flip-flop, and is also coupled through an OR gate 9 to a first input terminal of an AND gate 10 for rendering this AND gate enabled for a predetermined period of time.

A switch SW1 is provided for setting the present time with respect to the time counting circuit 3, and a switch SW2 is provided for setting an alarm time with respect to an alarm time memory circuit 11. These switches SW1 and SW2 are grounded at their one end. The other end of the switch SW1 is connected through a resistor r1 to a power supply terminal (which is held at a potential VDD) and also connected to an input terminal A of a presetting circuit 12. The other end of the switch SW2 is connected through a resistor r2 to a power supply terminal (held at potential VDD) and also connected to another input terminal B of the presetting circuit 12. When the switches SW1 and SW2 are operated in a predetermined order, preset time data PT and alarm time signal ALS are produced from respective output terminals C and D of the presetting circuit. The preset time data PT is preset as present time data in the time counting circuit 3, while the preset time data ALS is set as alarm time data in the alarm time memory circuit 11. The alarm time data preset in the alarm time memory circuit 11 is coupled as alarm time data AL to the display switching circuit 4, and it is also coupled to a second input terminal B of the coincidence circuit 7. The coincidence circuit 7 compares the present time data T and alarm time data AL respectively supplied to both the input terminals A and B. When both the inputs coincide, that is, when the present time reaches the alarm time, a coincidence signal EQ is produced and coupled to a set input terminal S of the flip-flop 8 to set this flip-flop 8. The set output signal of the flip-flop 8 is supplied as control signal to a sound generating circuit 13 which will be described later. The coincidence signal EQ is also coupled through the OR gate 9 to the AND gate 10. Since a pulse signal of frequency Φ has been supplied from the frequency divider 2 to the second input terminal of the AND gate 10, at the time of the appearance of the time signal H or coincidence signal EQ a pulse signal P is coupled from the AND gate 10 to the sound producing circuit 13.

A switch SW3 is a display select switch, which has one end grounded and the other end connected through a resistor r3 to a power supply terminal (at potential VDD) and also connected to a trigger input terminal T of a flip-flop 14. Every time the display select switch SW3 is operated, the flip-flop 14 is operated in a binary fashion, and its set and reset output terminals are coupled to the display select circuit 4. In the set state of the flip-flop 14, the display select circuit 4 selectively couples the present time data T from the time counting circuit 3 to the display section 6 for display therein, and in the reset state of the flip-flop 14 it selectively couples the alarm time data AL from the alarm time memory circuit 11 to the display section 6 for display therein.

Figure 2:
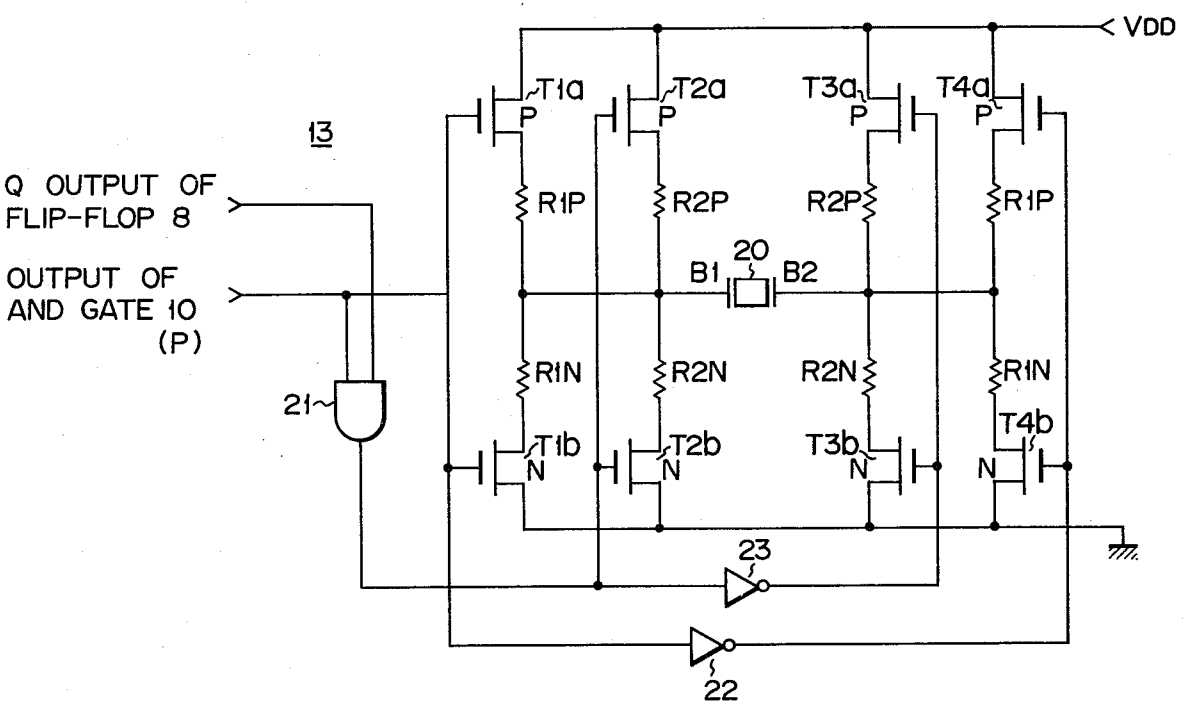
FIG. 2 is a circuit diagram showing the detail construction of the sound generating circuit in the embodiment of FIG. 1.

A specific construction of the sound generating circuit 13 will now be described in detail with reference to FIG. 2. In this sound generating circuit 13, a piezoelectric buzzer 30 is driven by a push-pull drive system to produce sound indicating the aforementioned alarm time or signaling time. In this embodiment, the volume of sound is automatically adjusted such that it is higher at the time of sound generation indicating the alarm time than at the time of signaling time. In this device, the change of the sound volume between the case of the alarm time and the case of the signaling time is obtained by making use of a capacitive property of the general piezoelectric buzzer. More particularly, when the resistance of a resistor connected across the piezoelectric buzzer is increased, the rising of voltage applied across the piezoelectric buzzer is increased due to the capacitive property mentioned above (i.e., time delay based upon transient phenomena) to reduce the potential difference between the opposite ends of the piezoelectric buffer (i.e., amplitude). Accordingly, in the instant device the resistance of the resistor connected across the piezoelectric buzzer is adapted to be increased in the case of sound generation indicating the signaling time. More particularly, the set output signal of the flip-flop 8 and the output signal of the AND gate 11 are coupled to the AND gate 21. Thus, the AND gate 21 is opened when producing the alarm time sound and is closed otherwise. The output signal of the AND gate 10, i.e., the aforementioned pulse signal P, is directly coupled to the gate terminals P- and N-channel MOS field-effect transistors (hereinafter referred to merely as transistors) T1*a* and T1*b*, and is also coupled through an inverter 22 to the gate terminals of P- and N-channel MOS field-effect transistors T3*a* and T3*b*. Meanwhile, the output signal of the AND gate 21 is directly coupled to the gate terminals of P- and N-channel MOS field-effect transistors T2*a* and T2*b*, and is also coupled through an inverter 23 to the gate terminals of P- and N-channel field-effect transistors T4*a* and T4*b*. The source terminals of the transistors T1*a* to T4*a* are connected to a power supply terminal (held at potential VDD). The drain terminals of the transistors T1*a* and T1*b* are connected through respective resistors R1P and R1N to one end B1 of the piezoelectric buzzer 20, and the drain terminals of the transistors T3*a* and T4*a* are connected through respective resistors R2P and R1P to the other end B2 of the piezoelectric buzzer 20. The aforementioned end B1 of the piezoelectric buzzer 20 is also connected through resistors R1N and R2N to the drain terminals of transistors T1*b* and T2*b*, and the other end B2 of the buzzer is connected through resistors R2N and R1N to the drain terminals of transistors T3*b* and T4*b*. The source terminals of transistors T1*b* to T4*b* are grounded.

The resistances of the resistors R1P, R2P, R1N and R2N are such that R1P=R1N>R2P=R2N.

Figure 3A:
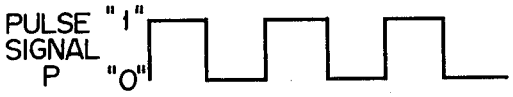
FIG. 3A shows a waveform of a pulse signal P.
Figure 3B:
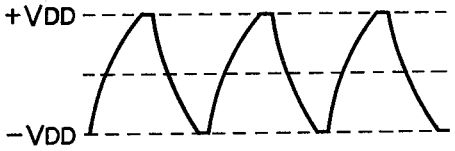
FIG. 3B shows a waveform of a voltage applied between the opposite ends of a piezoelectric buzzer at the time of alarm sound generation.
Figure 3C:
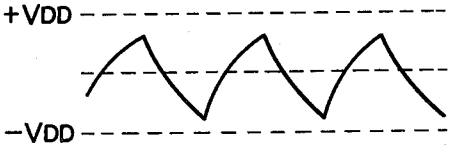
FIG. 3C shows a waveform of a voltage applied between the opposite ends of a piezoelectric buzzer at the time of time signaling sound generation.

The operation of this embodiment will now be described with reference to FIGS. 3A through 3C. It is assumed that an alarm time, for instance 6 a.m., has been preset with the operation of the switches SW1 and SW2. Thus, the present time information from the time counting circuit 3 and the alarm time data from the alarm time memory circuit 11 are supplied and compared. When the alarm time, i.e., 6 a.m., is reached, the coincidence signal of binary logic level "1" is produced from the coincidence circuit 7 to set the flip-flop 8 and open the AND gate 10. Thus, the flip-flop 8 produces the set output signal of level "1" to open the AND gate 10. At the same time, the pulse signal P is produced from the AND gate 10. During the "1" level period of the pulse signal P as shown in FIG. 3A, the transistors T1*a*, T2*a*, T3*b* and T4*b* are kept "off", while the transistors T1*b*, T2*b*, T3*a* and T4*a* are kept "on". Hence, during this period the end B1 of the piezoelectric buzzer 20 is grounded through the parallel resistors R1N and R2N, while the other end B2 of the buzzer is supplied with voltage VDD through the parallel resistors R2P and R1P. On the other hand, during the "0" level period of the pulse signal P, the transistors T1*a*, T2*a*, T3*b* and T4*b* are kept "on", and the transistors T1*b*, T2*b*, T3*a* and T4*a* are kept "off". Hence, during this period the end B1 of the piezoelectric buzzer 20 is supplied with voltage VDD through the parallel resistors R1P and R2P, while the other end B2 of the buzzer 20 is grounded through the parallel resistors R2N and R1N. Since the resistances of the resistors R1P, R2P, R1N and R2N are related such that $$R1P=R1N>R2P=R2N$$

as mentioned earlier, the difference between the voltages applied to the opposite ends B1 and B2 of the piezoelectric buzzer 20 is 2 VDD during both the "1" and "0" level periods. FIG. 3B shows the principal state of the voltage applied between the opposite ends B1 and B2 of the piezoelectric buzzer 20. The piezoelectric buzzer 20 is driven in a push-pull state by the voltage of the illustrated amplitude to produce alarm sound.

When a signaling time, for instance 7 a.m., is reached so that the time counting circuit 3 produces signaling time signal H of level "1" for a predetermined period of time, the flip-flop 8 is reset, while the AND gate 10 is held open and supplied the pulse signal P for that predetermined period. With the resetting of the flip-flop 8 and the AND gate 21 is closed. During the "1" level period of the pulse signal P, the transistors T1*a*, T2*b*, T3*a* and T4*b* are kept "off", while the transistors T1*b*, T2*a*, T3*b* and T4*a* are kept "on". Hence, during this period the end B1 of the piezoelectric buzzer 20 is supplied with a voltage obtained as a result of division of the voltage VDD between the series resistors R2P and R1N, namely substantially ½ VDD, while the other end B2 of the buzzer is supplied with a voltage obtained as a result of division of the voltage VDD between the series resistors R1P and R2N, namely substantially the same voltage ½ VDD. On the other hand, during the "0" level period of the pulse signal P, the transistors T1*b*, T2*b*, T3*a* and T4*a* are kept "off", while the transistors T1*a*, T2*a*, T3*b* and T4*b* are kept "on". This state is the same as that in the "0" level period of the pulse signal P at the time of the generation of the alarm sound; that is, voltage VDD is applied between the opposite ends (B1 and B2) of the piezoelectric buzzer 20. It will thus be seen that at the time of the time signaling sound generation, the resistance connected to the opposite ends B1 and B2 of the piezoelectric buzzer 20 is increased compared to that at the time of the alarm sound generation. In other words, in this case the waveform distortion is increased, and the amplitude of the voltage applied is thus reduced substantially to one half of the value at the time of the alarm sound generation as shown in FIG. 3C. Thus, the volume of the time signaling sound is substantially one half the volume of the alarm sound.

While the above embodiment is concerned with an electronic wristwatch, the invention is also applicable to other miniature electronic devices having a function of producing time information sound such as time signaling sound and alarm sound, for instance miniature electronic computers and clocks. Further, while the above embodiment has employed a piezoelectric buzzer as the sound generating means, it may be replaced with other sound generating means such as loudspeakers.

What is claimed is:

1. A miniature electronic device having a time informing sound generating function, comprising:

a source of reference frequency signals;

a time counting means for counting said reference frequency signals and for producing present time information and a signaling time signal;

means for setting an alarm time;

alarm signal generating means coupled to said time counting means and to said alarm time setting means for generating an alarm signal at the time of practical coincidence of an alarm time set in said alarm time setting means and the present time information provided by said time counting means;

sound generating means including means for receiving at least one of a signalling time signal and an alarm signal, a piezoelectronic buzzer and a driver coupled to said receiving means for push-pull driving of said piezoelectronic buzzer to thereby audibly inform of the signaling time and alarm time in response to said signaling time signal and to said alarm signal, respectively;

signal judging means responsive to a signal supplied to said receiving means of said sound generating means for judging whether the signal supplied to said sound generating means is a signaling time signal or an alarm signal; and sound volume control means coupled to said sound generating means and to said signal judging means for changing the voltage provided to said piezoelectric buzzer by said driver in accordance with the output signal from said signal judging means so as to generate different volume sounds responsive to said signaling time signal and alarm time signal, respectively.

2. The miniature electronic device of claim 1, wherein said sound generating means includes means for controlling the volume of sounds by applying a large potential difference to said piezoelectronic buzzer when said signal judging means judges that the signal supplied to said sound generating means is an alarm signal and by applying a small potential difference to said piezoelectronic buzzer when said signal judging means judges that the signal supplied to said sound generating means is a signaling time signal.

3. The miniature electronic device of claim 1 or 2, wherein said signal judging means comprises an R-S type flip-flop.

4. The miniature electronic device of claim 2, wherein:

said driver includes first, second, third and fourth resistors;

said piezoelectronic buzzer has at least one terminal connected to said first resistor and to said second resistor which has a resistance lower than that of said first resistor, and to said third resistor and fourth resistor which has a resistance lower than that of said third resistor, said first and second resistors being connected in parallel to a first power source potential and said third and fourth resistors being connected in parallel to a second power source potential of lower potential than that of said first power source; and said sound generating means includes selecting means for selectively coupling said second power source potential via one of said third and fourth resistors to said at least one terminal of said buzzer according to the output signal from said signal judging means.

5. The miniature electronic device of claim 4, wherein said selecting means comprises MOSFET switching transistors.

* * * * *